US005319866A

United States Patent [19]

Foley et al.

[11] Patent Number: 5,319,866

[45] Date of Patent: Jun. 14, 1994

[54] COMPOSITE ARCH MEMBER

[75] Inventors: Peter M. Foley, Needham; Steven F. Smith, Taunton, both of Mass.; Steven P. Liggett, Fort Collins, Colo.; Brian Igoe, Plainville, Mass.

[73] Assignee: Reebok International Ltd., Stoughton, Mass.

[21] Appl. No.: 748,079

[22] Filed: Aug. 21, 1991

[51] Int. Cl.[5] ..... A43B 13/12; A43B 13/24

[52] U.S. Cl. ..... 36/91; 36/103; 36/114; 36/31; 36/30 R; 36/148

[58] Field of Search ..... 36/30 A, 30 R, 32 R, 36/31, 91, 103, 114, 145, 148, 149, 166, 169, 171, 172

[56] References Cited

U.S. PATENT DOCUMENTS

| | | | |
|---|---|---|---|
| Re. 33,066 | 9/1989 | Stubblefield | 36/83 |
| 180,819 | 8/1876 | Ames | 36/28 |
| 634,588 | 10/1899 | Roche | 36/28 |
| 1,602,675 | 10/1926 | Hurley | 36/91 |
| 2,001,821 | 5/1935 | Everston | 36/169 |
| 2,070,116 | 2/1937 | Cutillo | 36/169 |
| 2,147,197 | 2/1939 | Glidden | 36/9 R |
| 2,275,720 | 3/1942 | Bingham, Jr. | 36/30 R |
| 2,325,639 | 8/1943 | Stritter | 36/169 |
| 2,678,506 | 5/1954 | Baroumes | 36/30 R |
| 2,698,490 | 1/1955 | Goldman | 36/172 |
| 3,586,003 | 6/1971 | Baker | 36/145 |
| 4,078,322 | 3/1978 | Dalebout | 36/121 |
| 4,316,334 | 2/1982 | Hunt . | |
| 4,335,530 | 6/1982 | Stubblefield | 36/83 |
| 4,398,357 | 8/1983 | Batra | 36/30 A |
| 4,399,621 | 8/1983 | Dassler . | |
| 4,454,662 | 6/1984 | Stubblefield | 36/91 |
| 4,546,559 | 10/1985 | Dassler | 36/31 |
| 4,676,010 | 6/1987 | Cheskin | 36/114 |
| 4,694,591 | 9/1987 | Banich et al. | 36/114 |
| 4,878,300 | 11/1989 | Bogaty | 36/114 |
| 4,922,631 | 5/1990 | Anderié | 36/114 |
| 5,052,130 | 10/1991 | Barry et al. | 36/114 |

FOREIGN PATENT DOCUMENTS

| | | | |
|---|---|---|---|
| 352807 | 1/1990 | European Pat. Off. . | |
| 2484215 | 12/1981 | Fed. Rep. of Germany | 36/9 R |
| WO91/16830 | 11/1991 | PCT Int'l Appl. . | |
| 2114869 | 9/1983 | United Kingdom . | |

OTHER PUBLICATIONS

SGD Sep. 1983, p. 101.
Running Times, Apr. 1991, pp. 23 and 26.
Runners World, Apr. 1991, pp. 58, 72 and 73.

*Primary Examiner*—Paul T. Sewell
*Assistant Examiner*—M. D. Patterson
*Attorney, Agent, or Firm*—Sterne, Kessler, Goldstein & Fox

[57] ABSTRACT

An athletic shoe is disclosed having a midsole which is substantially devoid of cushioning material in the arch region. An arch member is located in the arch region to provide support to the foot of a wearer.

17 Claims, 11 Drawing Sheets

COMPOSITE ARCH MEMBER

FIELD OF THE INVENTION

The present invention relates to athletic shoes and more particularly to an arch support member or an arch structure member for use in conjunction with an athletic shoe.

BACKGROUND OF THE INVENTION

In the last several years there has been an explosion in the public's awareness of the importance of physical activity. Commensurate with this explosion has been a flurry of technological advances in the field of athletic footwear. Many of these advances relate to either the fit or the function cf footwear. One area of footwear development which has not been adequately addressed is that of reducing the weight of an athletic shoe.

A conventional athletic shoe typically includes a number of components which have been traditionally considered to be "essential" elements of athletic footwear. Included in these "essential" components is the outsole. The outsole of an athletic shoe is the ground engaging portion of the shoe. As such, the outsole is typically made of an abrasive resistant material such as rubber. Because it is critical that the outsole exhibit certain wear resistent characteristics, there are a finite number of materials from which to make an outsole.

Another element of a conventional athletic shoe is the midsole. The midsole is that portion of the shoe which is primarily responsible for cushioning. While recent years have brought many variations to midsole design such as the use of inserts, the principal materials used to supply cushioning include polyurethane (PU) and ethylvinyl acetate (EVA) foams. More recently, foams made of HYTREL TM have been used as the cushioning material for midsoles. HYTREL TM, manufactured by E.I. DuPont de Nemours & Company, Inc., is a semicrystalline, fully polymerized, high molecular weight elastomer composed of alternate amorphous and crystalline chains. In many athletic shoes, a contoured foam sockliner is disposed above the midsole to provide additional cushioning and support.

Finally, the upper, that portion of the athletic shoe which surrounds and protects the foot, is an element which is typically found in footwear.

With little exception, it is a goal of an athletic shoe maker to produce a shoe which is as light as possible. However, the shoe maker is faced with competing interests which oftentimes require sacrificing weight for another required characteristic of the shoe. For instance, if an athletic shoe is to provide sufficient support to the ankle, the athletic shoe must incorporate materials having sufficient density to accomplish the desired effect. Some inroads have been made in this regard by the use of advanced cushioning technologies. Similarly, it may be necessary to use a specific density of PU or EVA in the midsole to provide adequate support and cushioning to the wearer. One technique used to reduce the weight of a shoe is to reduce the density of the material used to form the midsole. To support the low density midsole material, a mechanical insert may be embedded in the lower density material to provide the structural support necessary to provide adequate stability.

While mechanical frames and inserts in many cases serve to provide a structure to store and return energy to the midsole, the effectiveness of these structures is primarily in the mechanical performance of the midsole and not in weight reduction. In short, while these structures perform an important function in the performance of athletic footwear by serving to maintain the structure of the midsole and to help the midsole to recover from the application of a force, they do not serve to substantially reduce the weight of an athletic shoe.

One technique which has been used to reduce weight in an athletic shoe is to remove those portions of the outsole which are not needed. Many athletic shoes on the market have either openings in the outsole or have had outsole material removed in certain regions. The removal of this material serves to reduce the weight of shoes but not nearly to the extent possible.

More recently, some companies have taken the additional step of removing material not only from the outsole but also from the midsole. While removing material from the midsole is effective to reduce the weight of a shoe, this course can not be taken haphazardly. The prior art has not recognized those regions of the foot in which material can be fully removed.

In order for a shoe to take into account the structural anatomy and requirements of the foot, the physiological aspects of the foot must be understood. The human foot is a complex structure which depends on twenty-six bones to work in conjunction with each other to support the weight of their owner and to transport the body under a number of different conditions. The tapestry of bones which make up the foot not only supports the weight of the body but withstands forces of perhaps 250% of normal body weight which can occur, for example, during jogging.

The foot can be broken down into three basic functional segments. The posterior segment is that segment underlying and supporting the tibia. This segment includes the talus which directly underlies the tibia and the calcaneus, that portion of the foot which will typically make first contact with the ground during a normal gait cycle. The second segment is simply known as the middle segment. The middle segment of the foot contains five tarsal bones which are arranged in a complex geometrical formation. The third segment is the anterior segment which includes five metatarsal bones and fourteen phalangeal bones (three for each toe with the exception of the great toe which has two).

An analysis of the movement of the foot allows footwear to be produced with a structure that is commensurate with the requirements of the foot. Ignoring the requirements of the foot results in footwear that provides adequate cushioning only by utilizing cushioning material for virtually every structural component of a shoe. The result is a well cushioned (but heavy) shoe.

Human movement or locomotion is the translation of the body from one location to another. This movement occurs in a remarkably efficient manner. The particular way or fashion of moving on foot is called "gait." All the determinants of gait tend to minimize the amount of energy it takes to move from one location to another. Thus, the body works to minimize all forces which tend to impede the movement. The foot works with the remainder of the body to move in the most efficient way possible. During walking, there are two general phases, the swing phase (when the foot is not in contact with the ground) and the stance phase (when the foot is in contact with the ground). The stance phase is the important phase to analyze to determine what physiological criteria must be utilized in order to make the optimal shoe. Interestingly, it is the swing phase which drives the development of the present invention in that it is during this phase that it is critical to have footwear with a minimum possible weight. In order to determine how to reduce the weight of the shoe, the stance phase must be analyzed.

The stance phase of the gait cycle begins with heel strike. During heel strike the foot is typically in a supinated orientation. The foot pronates and the metatarsal heads make contact with the ground. At this mid-stance orientation the weight of the body bears primarily at the heel and at the metatarsal heads. The heel then lifts in the heel-off phase of the gait cycle. Finally the stance phase ends with toe-off after which the foot again supines. A similar cycle occurs during jogging.

In short, the contact of the heel with the ground is typically referred to as heel strike. The weight of the person proceeds along the lateral border of the foot toward the metatarsal heads with the major propulsion thrust by the distal phalanx of the great toe.

Whether a person is running, walking, jogging or simply standing, there are certain cushioning requirements. Typically, the prior art has incorporated cushioning under the entire foot, including the arch. However, with the weight of the person shifting along the lateral side of the foot, cushioning to the extent found in athletic shoes is simply not needed in the arch.

The arch of the foot is formed in part by the orientation of the bones. The bones are oriented in substantially a bow shape with the calcaneus forming one end of the bow, the metatarsal heads forming the other end of the bow. Forces are applied to the bow at a point (at the talus) between the calcaneus and the metatarsal heads. Thus, when downward force is applied to the talus, there are equal and opposite forces applied at the two ends of the bow. A muscle known as the planter fascia extends from the medial tubercle of the calcaneus to the toes. The planter fascia runs anteriorly from the calcaneus and splits into five bands, one attached to each toe. During running tremendous stress can be placed on the fascia planter. Simple mechanics dictate that when a downward force through the talus force is placed at the calcaneus and at the metatarsal heads, as is the case during most activities, the planter fascia tends to want to stretch. One of the objects of the present invention is to support the arch of the foot and to at the same time make a lighter shoe than those previously known in the art.

Accordingly, one of the features of the present invention is that it provides an athletic shoe of reduced weight. Because of the unique aspects of the present invention, the reduction in weight may be made without adversely effecting the performance of the athletic shoe. Additionally, one feature of the present invention is that it enables a number of different technologies to be used in conjunction with the invention. Additional objects, advantages, and novel features of the invention will be set forth in the description which follows, and in part will become apparent to those skilled in the art upon examination of the following or may be learned from practice of the invention. The objects and advantages of the invention may be realized and attained by means of the instrumentalities and combinations pointed out below.

SUMMARY OF THE INVENTION

To achieve the forgoing and other objects and in accordance with the purpose of the present invention, as embodied and broadly described herein, the athletic shoe of the present invention may include an athletic shoe having a sole. The sole has a forefoot region, a posterior or heel region and an arch region. The midsole is substantially devoid of cushioning material in the arch region. An arch member is located in the arch region to provide support to the foot of a wearer.

In one aspect of the invention, the arch member comprises a carbon-glass weave with the carbon fibers oriented in the anterior-posterior direction and glass fibers oriented in the medial-lateral direction. The woven material is covered with an epoxy resin coating.

In another aspect of the invention, there is no midsole or outsole in the entire region underlying the arch of the foot.

DETAILED DESCRIPTION OF THE PREFERRED EMBODIMENTS

Figure 1:
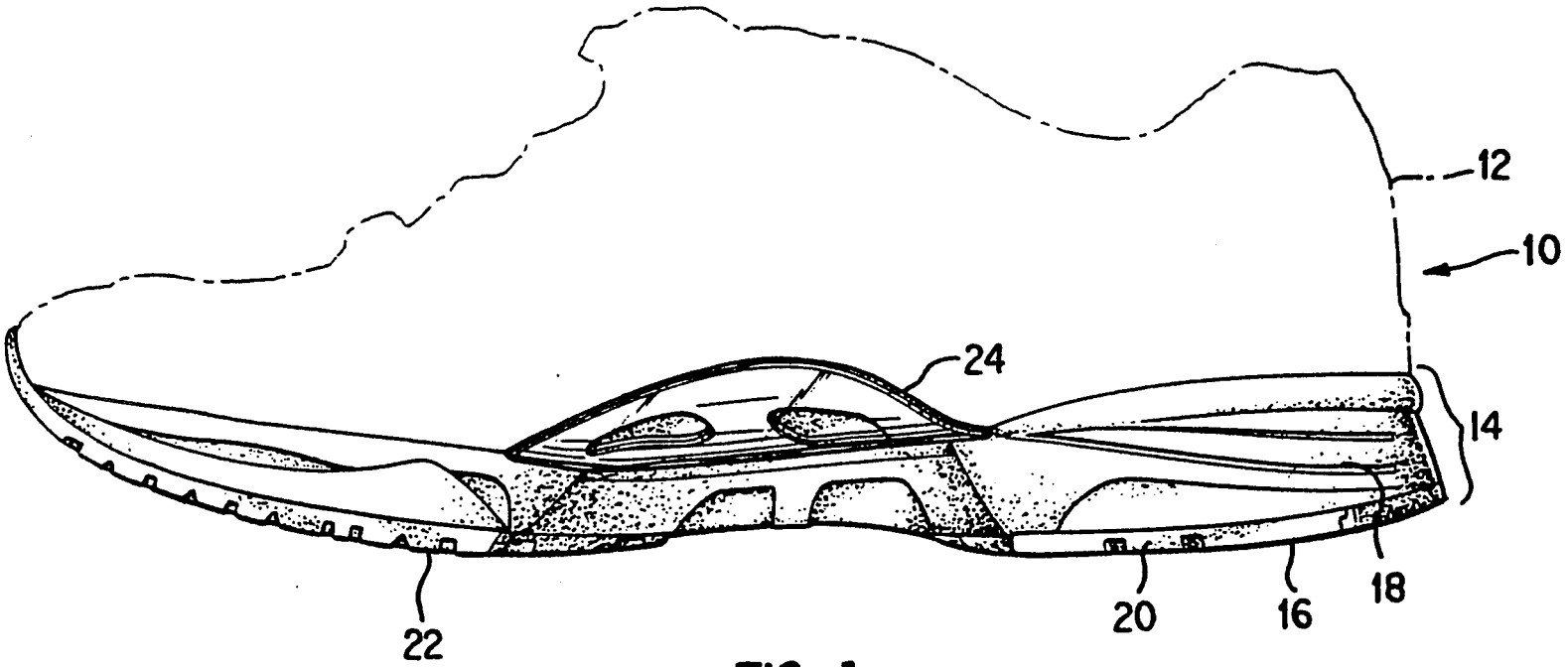
FIG. 1 is a medial side elevational view of a sole incorporating the invention.
Figure 2:
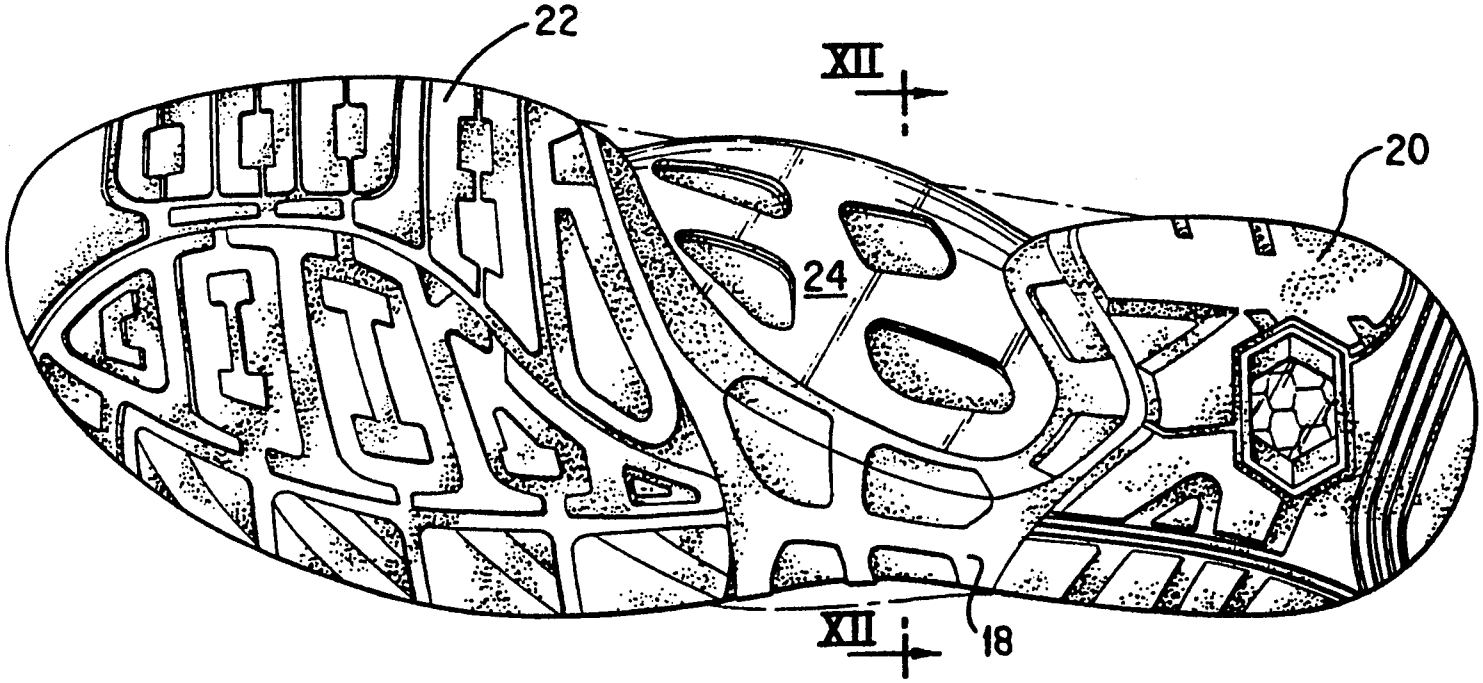
FIG. 2 is a bottom view of the sole depicted in FIG. 1.

Referring to the accompanying drawings, wherein like numbers indicate like elements, FIGS. 1–4 show an athletic shoe designated generally by reference number 10. While FIGS. 1–4 depict a shoe for use on the right foot of a wearer, the principles of the invention are equally applicable for shoes intended for use on the left foot of a wearer. While the following description of the preferred embodiment of the invention is specifically directed toward athletic shoes and in particular to shoes for running, it is anticipated that the invention could be adapted for use in various other types of footwear other than those specifically mentioned. For example, the principles of the present invention could be translated into use in shoes for walking or aerobics, basketball, tennis and the like.

Athletic shoe 10 includes an upper 12 (depicted in phantom) which is that portion of the shoe which protects the upper portion of the foot of the wearer. The upper may be made of any of various materials including those which are conventionally used in athletic footwear. For example, the upper may be made of either a natural material such as leather or a synthetic material. The upper 12 may also be made of a woven material, a non-woven material, or both. Typically, upper 12 will be made of a flexible material if used in an athletic shoe.

Attached to the upper 12 is sole 14 which is that part of the shoe which generally underlies the foot. Sole 14 serves three primary purposes: cushioning, protection and support. The manner in which each of these functions is accomplished by the present invention will be discussed in further detail below.

Sole 14 generally can be divided into three regions: heel, arch and forefoot. The heel region is that part of the sole which underlies the heel of the foot of a wearer; the arch region is that part of the sole which underlies the arch of the foot of a wearer; and, accordingly, the forefoot region is that region which underlies the forefoot of the foot of a wearer.

Sole 14 has several component parts which include an outsole 16, and a midsole 18. The outsole 16 is that portion of the shoe which contacts the ground. One of the primary purposes of the outsole is to protect the foot. It also may serves the cushioning function. The outsole 16 may be made from an abrasive resistant material such as rubber. In the embodiment of the invention depicted in FIGS. 1-4, the outsole is actually formed from two discrete components, the heel pad 20 and the forefoot pad 22. The heel pad 20 and the forefoot pad 22 may be formed out of the same material or may be made from different materials. Although the heel pad 20 and the forefoot pad 22 may be separate components, they will be referred to collectively as the outsole. It should be noted that it may be possible to practice the invention without the need for either the forefoot pad 22, the heel pad 20 or both. In the embodiment of the invention shown in the accompanying drawings, the forefoot pad 22 is made of a material which is softer than the material forming the heel pad 20. Specifically, forefoot pad 22 may be formed from a blown rubber and heel pad 20 from a solid rubber. However, many different outsole configurations could be used in conjunction with the present invention.

Figure 3:
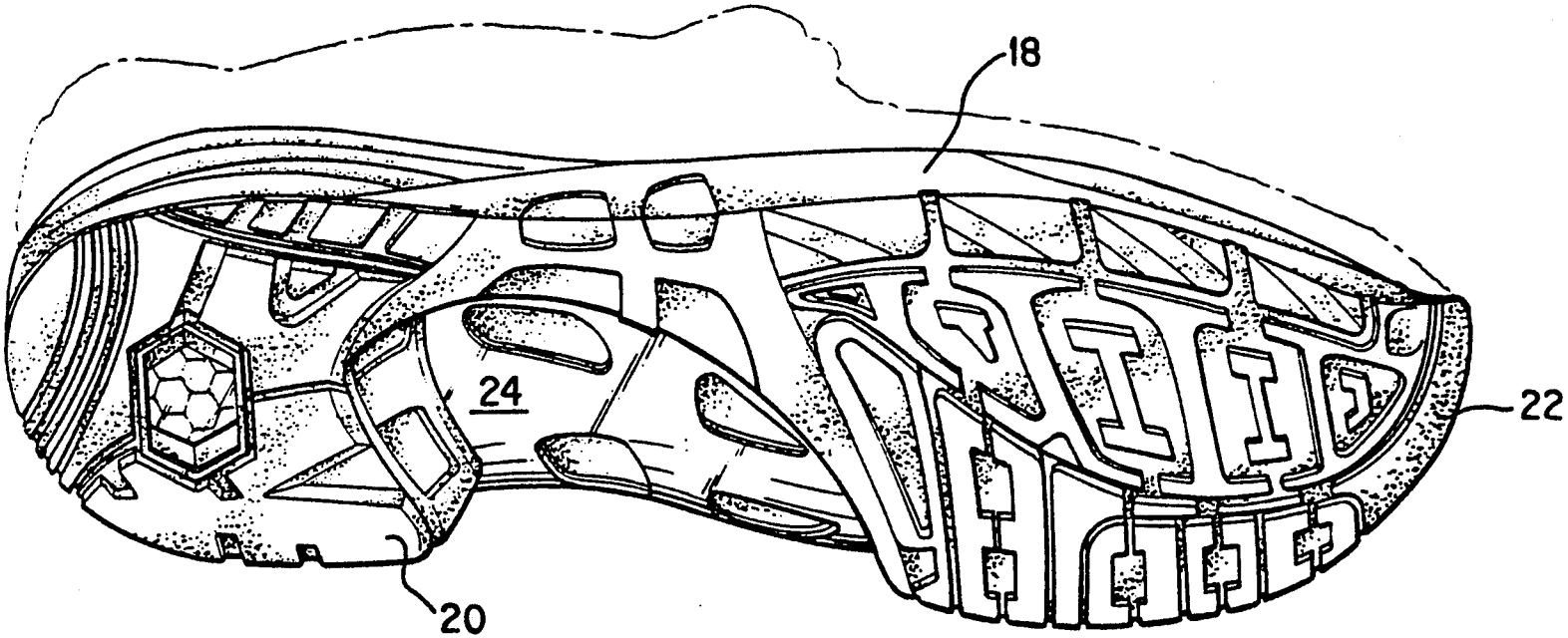
FIG. 3 is a perspective view from the lateral, or left, side of the sole depicted in FIG. 1.
Figure 4:
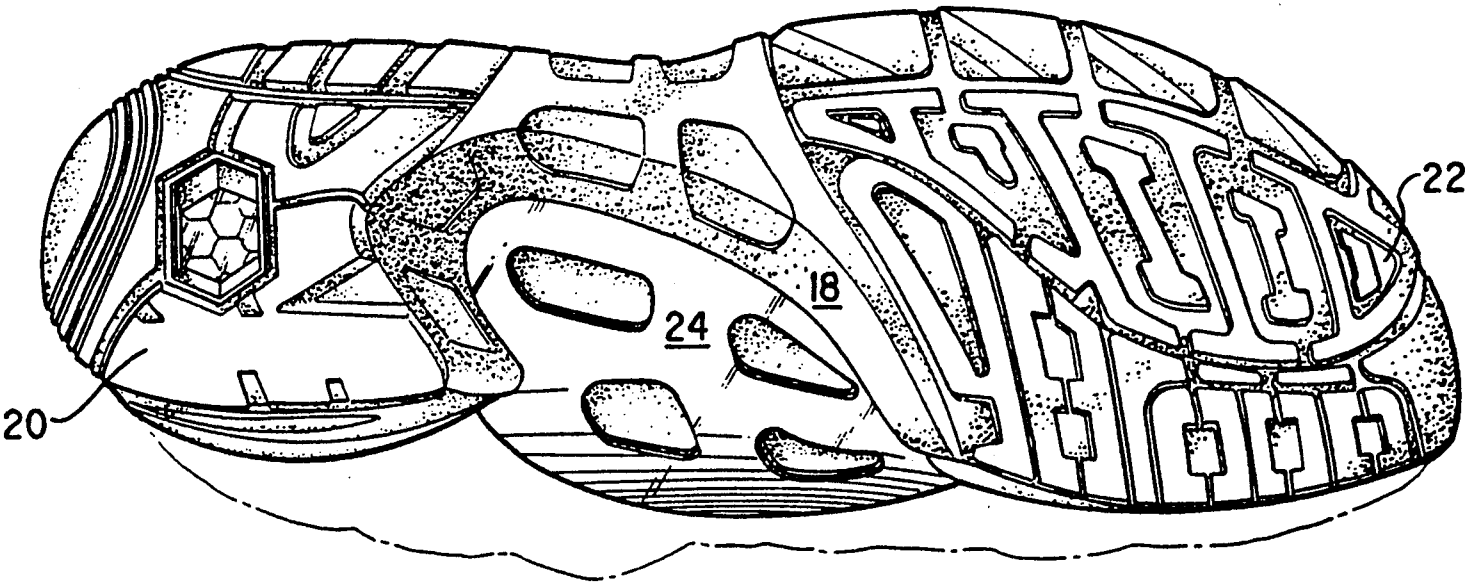
FIG. 4 is a perspective view from the medial, or right, side of the sole depicted in FIG. 1.

The present invention takes a radical departure from conventional soles by utilizing a midsole with significantly less foam material than a conventional midsole. Specifically, all of the material found in the arch region of a conventional midsole is absent in a preferred embodiment of the present invention. In addition, the outsole material underlying the sole may be absent. This is best seen in FIGS. 3 and 4 which show that both midsole and outsole material have been removed from the entire region underlying the arch region of the foot of the wearer. The present invention replaces the midsole in the arch region of the sole 14 with a stiff arch member 24. This stiff arch member 24 serves the purpose of supporting the foot of the wearer while reducing the overall weight of the athletic shoe. Details of the arch member 24 will be described in further detail below.

Figure 5:
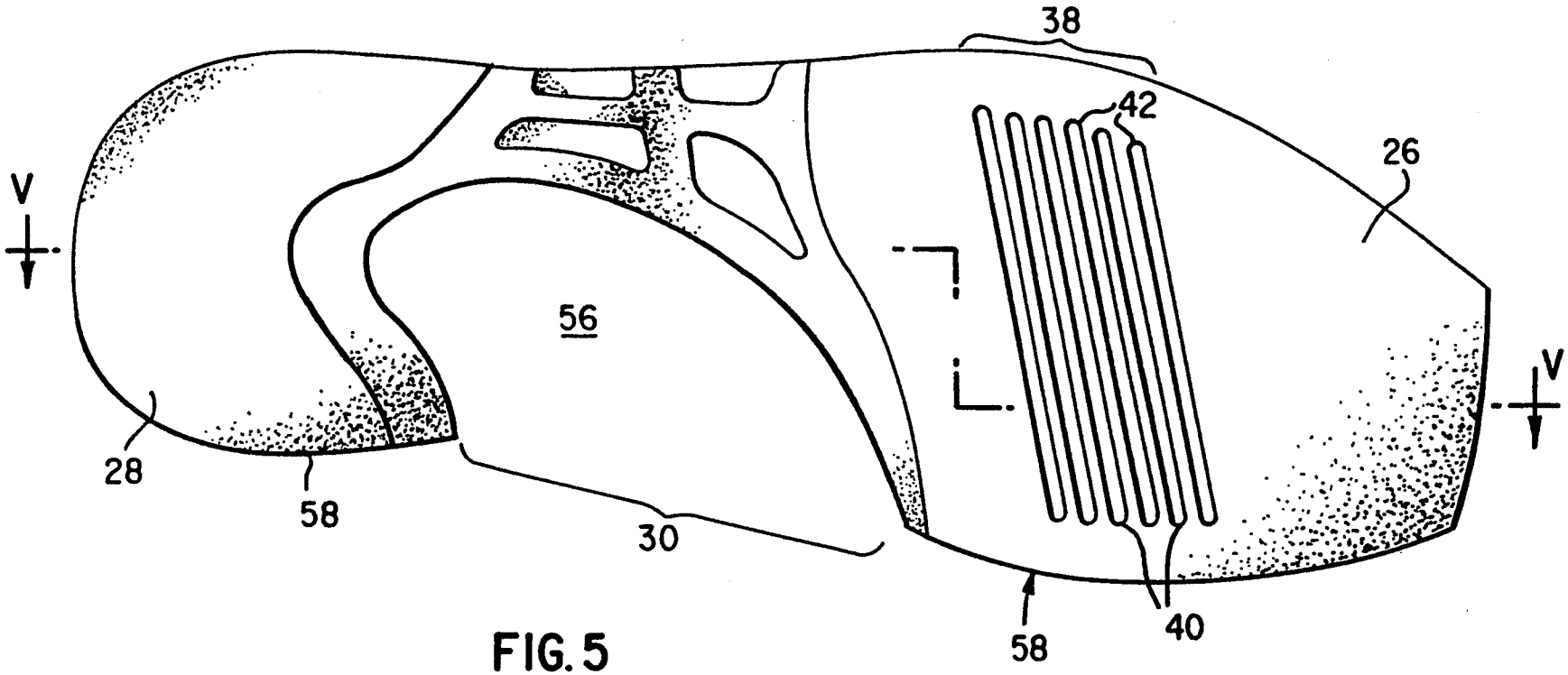
FIG. 5 is a top view of a midsole for use with the present invention.
Figure 6:
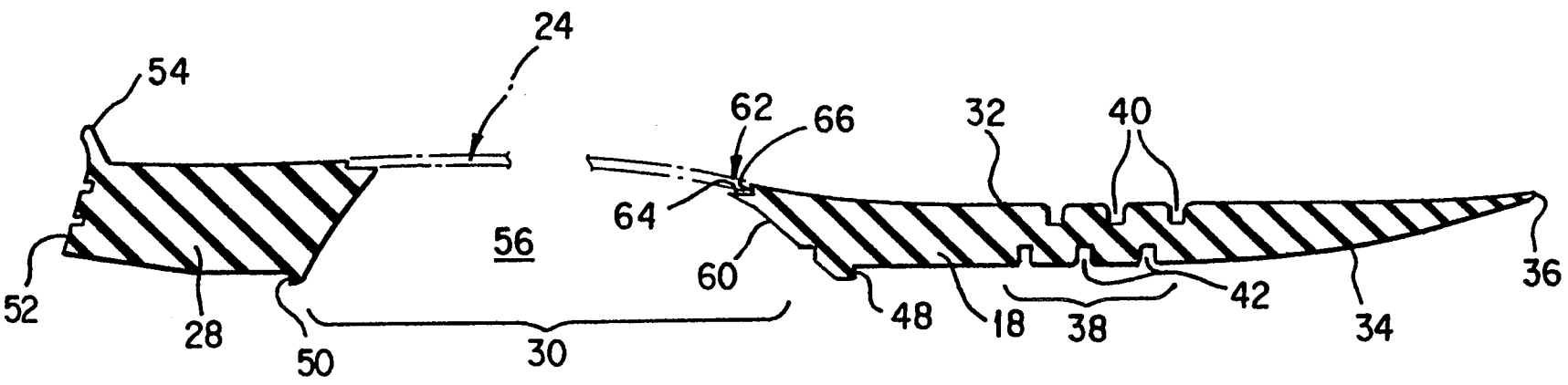
FIG. 6 is a cross-sectional view taken along line V—V of FIG. 5.
Figure 8:
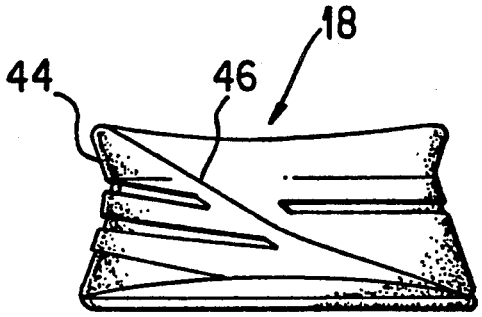
FIG. 8 is a back view of one embodiment of a midsole for use with the present invention.

The midsole per se of the present invention is best seen by reference to FIGS. 5 and 6. The midsole that is used in conjunction with the present invention may be formed or molded from any suitable cushion material, and is preferably formed of a foam selected from the group which includes polyurethane (PU) ethylvinyl acetate (EVA) and HYTREL TM foam (HYTREL TM is a material made by E.I. DuPont de Nemours, Wilmington, Del., the foamed HYTREL TM product is made by Astro Valcour, Glens Falls, N.Y.). Another possible material for use in forming the midsole 18 is EVA with fillers used to reduce the specific gravity of the material. Although many different midsole materials are suitable for practicing the invention, in one embodiment of the invention, HYLITE having a hardness of approximately 55 Asker C is preferably used. It is also possible for the posterior region 28 to be formed from two materials having different densities. The medial portion 44 of midsole 18 in the posterior region 28 may have a density of 65 Asker C, while the remaining portions of the midsole have a density which is lower, e.g. 55 Asker C. As can be seen in FIG. 8, the medial portion 44 can be angled to form junction 46 between the medial portion 44 and the remaining portion of the midsole.

FIG. 5 depicts a bottom plan view of the midsole 18 used in conjunction with the present invention. FIG. 6 in turn is a cross-sectional view of FIG. 5 cut along line V—V. The midsole 18 includes an anterior region 26, a posterior region 28, and an arch region 30. While there is no clear demarcation between the anterior region 26, the posterior region 28, and the arch region 30, the arch region is generally that region that underlies the arch of the foot of a wearer. The opening 56 depicted in FIG. 5 is commensurate in size with arch region 30 and generally corresponds to a large portion of the foot which does not make contact with the ground. The anterior region 26, or forefoot region of midsole 18 has a generally flat upper surface 32 and a curved lower surface 34 which taper to an anterior terminus 36. The anterior region 26 of midsole 18 may include a flex region 38 which generally underlies the metatarsal heads of the wearer and allows the midsole to bend or flex more easily in that area of the midsole. During a normal gait cycle, the foot bends along the metatarsal heads prior to toe off. Therefore, it is useful to provide a flex region 38. In one embodiment, the flex area includes a series of upper grooves 40 and lower grooves 42 which may be oriented in a staggered arrangement. This staggered arrangement is best seen in FIG. 6. In the embodiment of the invention depicted in FIGS. 6 and 7, the upper grooves 40 are separated by approximately 9.0 mm (measured from closest distance between grooves). The upper grooves may have a width of approximately 3.0 mm and a depth of 4.0 mm. Similar dimensions may be utilized for the lower grooves 42. The upper grooves 40 and the lower grooves 42 may be angled to generally overlie the metatarsal heads of the wearer's foot. The overall thickness of midsole 18 in the flex region 38 is approximately 12.0 mm.

The midsole 18 may include a first shoulder 48 and a second shoulder 50. The outsole 16 may abut against this first shoulder 48 and extend anteriorly to the midsole terminus 36. The heel pad 20 of the outsole 16 may abut against this second shoulder 50 and extend posteriorly toward the posterior terminus 52 of the shoe 10. An extension 54 wraps onto upper 12 to provide additional support to the foot of a wearer.

The foam material forming the midsole 18 defines a large opening 56. The opening underlies the arch of the foot of the wearer. The opening 56 extends nearly the entire width of midsole 18 and may extend approximately one-third the length of the shoe along medial edge 58 (for a shoe having a length of 295.5 mm the length of the opening 56 along the medial edge 58 of midsole 18 is approximately 92.0 mm measured along a line substantially parallel to the longitudinal axis of the midsole). Opening 56 is of such a substantial size that the weight of a men's size 9 running shoe may be reduced up to thirty grams, or more. Opening 56 in midsole 18 may include a sidewall 60 which tapers downwardly.

Adjacent the upper edge of the sidewall is a seating edge 62 having a bottom surface 64 and a side surface 66. The bottom surface 64 and the side surface 66 have dimensions suitable for seating the stiff composite arch member 24 (shown in phantom in FIG. 6).

Figure 7:
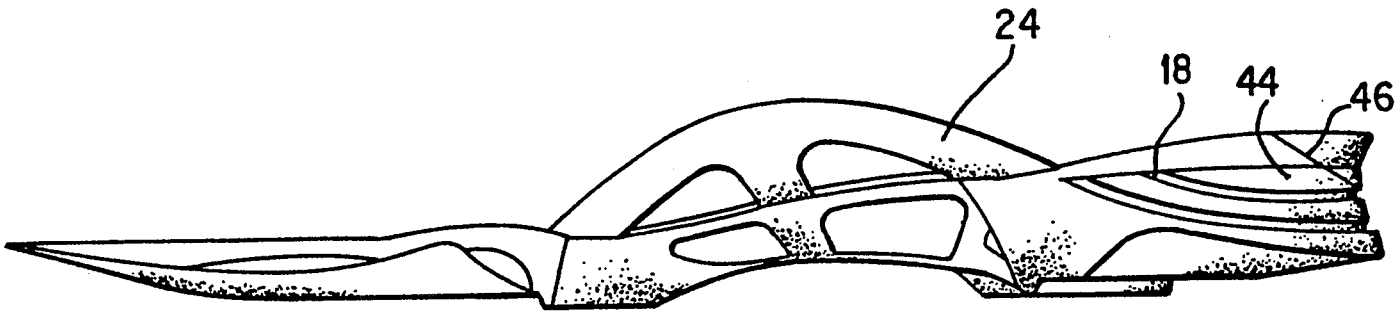
FIG. 7 is a side view of a sole incorporating the invention.

FIG. 7 is a medial side view of a midsole 18 showing the incorporation of arch member 24. The arch member 24 extends away from the page and upward to support the arch of a wearer. FIG. 8 shows a rear view of FIG. 7 showing the dual midsole density configuration previously discussed.

Figure 9:
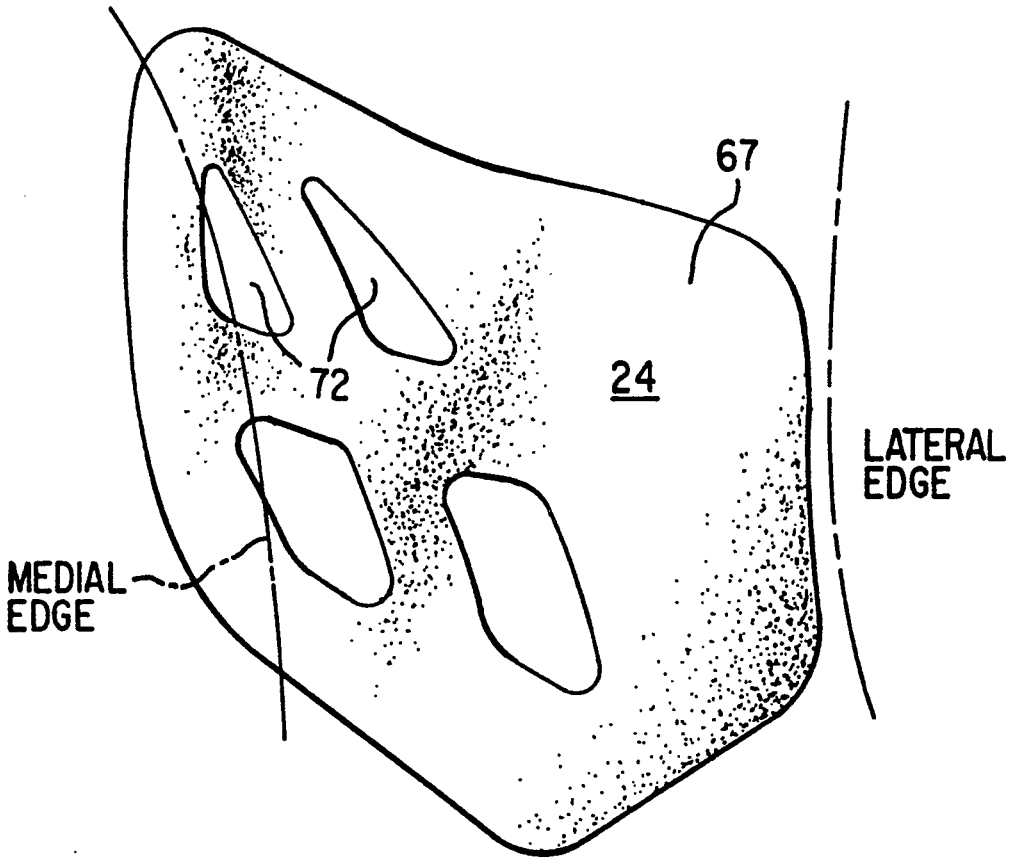
FIG. 9 is a top schematic showing of the insert of the present invention.
Figure 10:
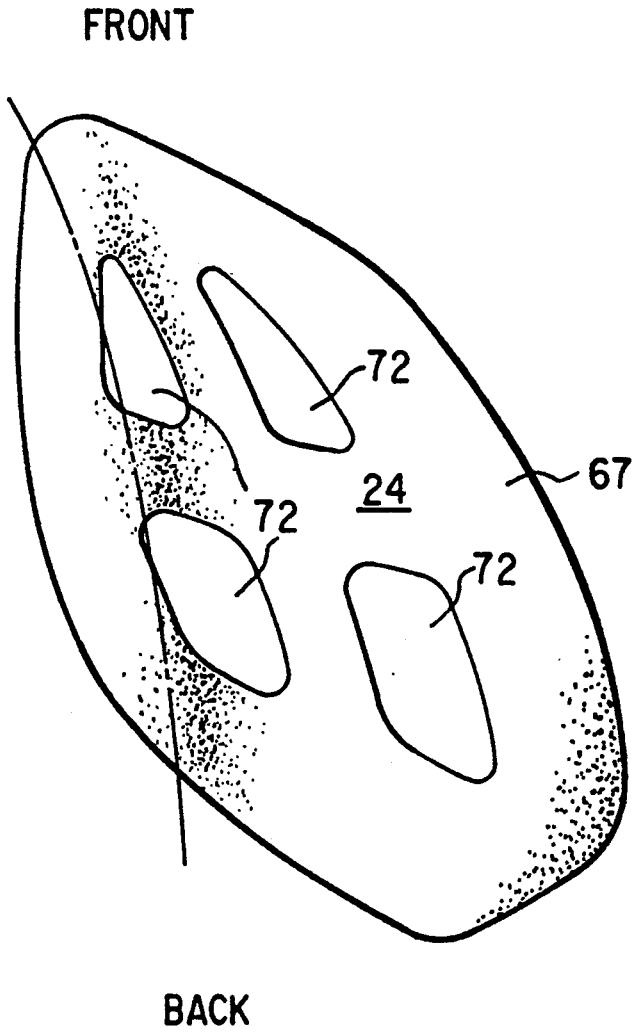
FIG. 10 is another embodiment of an insert of the present invention.

Referring to FIGS. 9 and 10, a projection of the composite arch member 24 is shown. The arch members of FIGS. 9 and 10 differ in that the arch member 24 of FIG. 10 has a bonding margin 67 of about 10.0 mm for bonding with the midsole, while the arch member 24 shown in FIG. 9 has a much larger area for which to bond the arch member with the midsole 18. It has been found that the geometry of the arch member depicted in FIG. 9 is a preferred embodiment and that the larger bonding margin provides additional support. The arch member serves the purpose of supporting the foot of the wearer in the arch region of a wearer's foot. By using a stiff support member in the arch area of the athletic shoe, considerable weight is saved. The arch member 24 may be configured in any suitable fashion to accomplish the support objectives of the invention.

Figure 11:
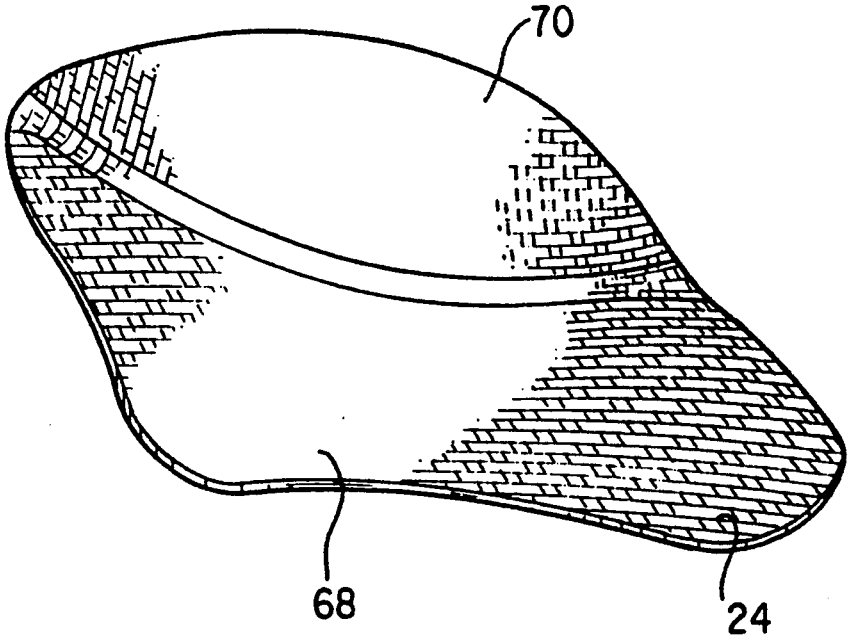
FIG. 11 is a perspective view of an insert of the present invention.

FIG. 11 is a perspective view of an arch member 24 per se. The arch member shown in FIG. 11 is substantially identical in shape to the insert depicted in FIG. 9 with a substantially planar surface 68 which lies directly under the foot of a wearer. It should be noted that the arch member 24 in FIG. 11 is for use in a shoe for the left foot of a wearer, and is therefore substantially a mirror image of inserts shown in FIGS. 1–4. The arch member medial side 70 curves upwardly to follow the shape of the foot. The arch member 24 defines apertures 72 (see FIGS. 9–10). Apertures 72 may serve a number of different functions. Apertures 72 may help reduce the stiffness and weight of the arch member 24. Moreover, apertures 72 serve an aesthetic function by enabling viewing of material 74 which may overlie the arch member 24 (material 74 is a thin material disposed on the surface of an open cell foam 80 which is best seen in FIG. 12, a cross section of FIG. 2 cut along line XII—XII).

The arch member 24 may be made of a relatively stiff material such as a woven graphite material. Although it is possible for the arch member to take on different forms, it is preferable for the thickness to be less than about 50/1000 inch and a preferred thickness is about 30/1000 inch.

In one embodiment of the invention a carbon-glass weave may be used to form arch member 24. In this embodiment, the carbon material runs in the anterior-posterior direction of the arch member, while the glass is oriented to run in the medial-lateral direction. Using a weave of 50% carbon and 50% glass, an epoxy resin system is poured over at least one surface of the weave. Other materials for use in making the arch member 24 include a carbon/aramid (KEVLAR)/glass composite. Suitable coatings include PELLETHANE (available from Dow Chemical Co.) or NUCREL (available from E.I. DuPont de Nemours).

Figure 12:
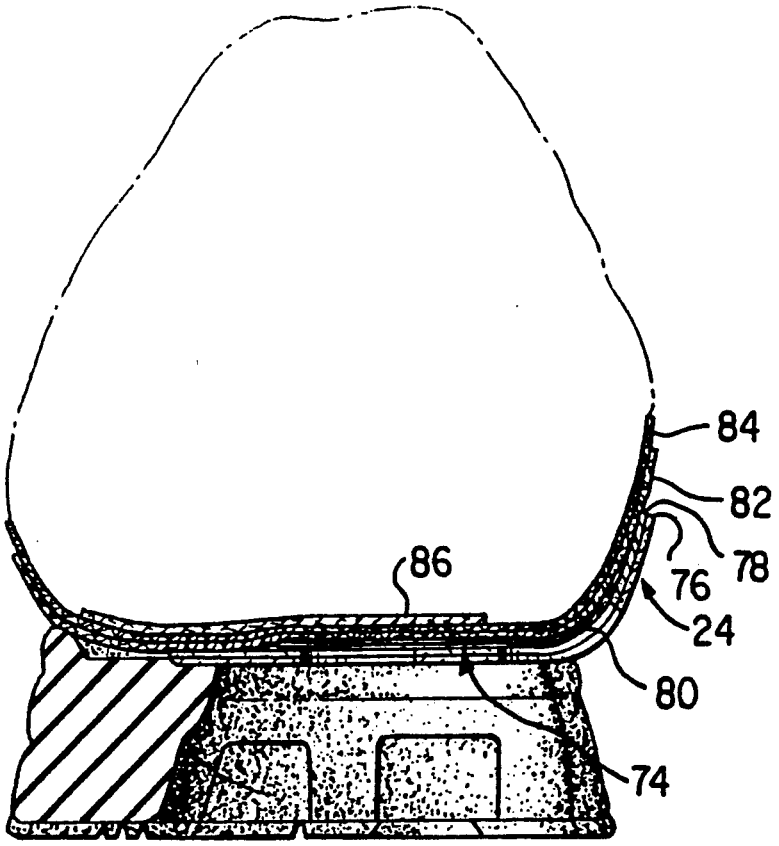
FIG. 12 is a cross-sectional view of FIG. 2 cut along line XII—XII.

FIG. 12 shows the arch member 24 and its component parts which may include a woven layer 76 and an epoxy layer 78. Disposed above the arch member 24 is a lightweight open cell foam 80. Disposed above the open cell foam 80 may be a thin woven material or cloth. Overlying the open cell foam 80 and thin woven material are layers 82,84 which are made of any suitable material and may form a part of the upper 12. An insole board 86, as is well known in the art, is disposed above material layers 82,84 as shown in FIG. 12. The insole board may run the entire length of the shoe. Although not shown, a sockliner may be located above the insole board. The sockliner may be made of any suitable cushioning material and may be removable.

In operation, the arch member supplies support for the arch of the wearer. It is not a purpose of the invention to supply cushioning to the arch although having a cushioning aspect in conjunction with the invention is not inapposite to the invention. The arch member replaces midsole and outsole material which typically takes up the space underlying the arch. The arch member provides support in a light weight shoe without interfering with the natural gait cycle.

The foregoing description of the preferred embodiments of the invention have been presented for the purposes of illustration and description. It is not intended to be exhaustive or to limit the invention to the precise form disclosed, and obviously many possible modifications and variations are possible in light of the above teaching. For example, it may be desired to place ridges or other means for flexing in the arch member in order for it to bend in accordance with the specifications of the shoe designer. It may also be desired for the arch member to be made from a homogenous piece of material or for the arch member to vary in thickness as a mechanism to control the bending of the arch member. It may also be desired to make the arch member removable so that an arch member with a different contour could be used in the shoe. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A lightweight athletic shoe comprising:

(a) an upper;

(b) a sole attached to said upper, said sole including a heel region, a forefoot region, and an arch region, said sole having an abrasive resistant material forming an outsole and a cushioning material forming a midsole wherein said arch region of said sole is substantially devoid of said abrasive resistant material forming said outsole and said midsole material forming said midsole, said sole further comprising an arch support member wherein said arch support member comprises a material sufficiently rigid to support the arch of a wearer, and wherein said arch support member has a substantially planar first surface, said substantially planar first surface being attached to said material forming said midsole, and a curved second surface, said curved second surface being shaped to substantially conform to the arch of a wearer.

2. An athletic shoe, comprising:

(a) an upper;

(b) a sole attached to said upper, said sole having a heel region, an arch region and a forefoot region; said sole including an abrasive resistant outsole for contacting the ground, and a midsole for providing cushioning, said arch region of said sole being substantially devoid of midsole and outsole; and (c) an arch member located in the arch region of said sole which is substantially devoid of midsole and outsole, said arch member being shaped to substantially conform to the arch of a wearer thereby providing support to a foot of a wearer.

3. The athletic shoe of claim 2, wherein said arch member comprises a carbon, an aramid and glass composite material.

4. The athletic shoe of claim 2, wherein said arch member define a plurality of holes for decreasing the weight of said arch member.

5. An athletic shoe, comprising:

(a) an upper; and (b) a sole, said sole including an abrasive resistant outsole for contacting the ground; a midsole for providing cushioning; and an arch member, said arch member being made of a material having a rigidity sufficient to support the arch of a wearer and being located substantially below and being shaped to conform substantially to the arch of a wearer of the athletic shoe, said arch member being positioned forward of the area of heel strike and behind the area underlying the ball of the foot of a wearer in a region of said sole substantially devoid of midsole above said support member; said arch member providing support to the arch of a wearer; said midsole including a sidewall, the upper edge of said sidewall positioned adjacent said arch member so that said arch member and said sidewall define a region which is devoid of material.

6. The athletic shoe of claim 5, wherein said arch member comprises a carbon, an aramid and glass composite material.

7. The athletic shoe of claim 5, wherein said arch member defines a plurality of holes for decreasing the weight of said arch member.

8. The athletic shoe of claim 5, wherein said arch member has a thickness of less than 50/1000 inch.

9. The athletic shoe of claim 5, wherein said arch member has a thickness of approximately 30/1000 inch.

10. The athletic shoe of claim 5, wherein said arch member further comprises a coating.

11. The athletic shoe of claim 10, wherein said coating comprises an epoxy resin.

12. An athletic shoe comprising:

(a) an upper;

(b) the sole attached to said upper, said sole including an abrasive resistant outsole for contacting the ground; a midsole providing cushioning, said midsole including a sidewall; and a support member, said support member being made from a material having a hardness sufficient to provide support to a foot of a wearer, at least a portion of said support member being positioned forward of the area of heel strike behind the area underlying the ball of the foot of a wearer in a region of said sole substantially devoid of midsole above said support member, wherein the upper edge of said sidewall is positioned adjacent said support member so that said support member and said sidewall define a region which is devoid of material.

13. The athletic shoe of claim 12, wherein said support member is located substantially below the arch region of a foot of a wearer.

14. The athletic shoe of claim 12, wherein said support member conforms to the arch region of the foot of the wearer.

15. An athletic shoe, comprising:

(a) an upper;

(b) a sole attached to said upper, said sole having a heel region, an arch region, and a forefoot region, said sole including a midsole for providing cushioning, said midsole including a sidewall; and (c) a support member, said support member being made from a material having a hardness sufficient to provide support to a foot of a wearer, said support member positioned adjacent said upper in a region of said sole substantially devoid of midsole above said support member, said support member positioned adjacent the upper edge of said sidewall so that said support member and said sidewall define a region which is substantially devoid of material.

16. The athletic shoe of claim 15, wherein said support member is positioned forward of the area of heel strike and behind the area underlying the ball of the foot of a wearer, said support member having a curved surface shaped to substantially conform to the arch of a wearer.

17. The athletic shoe of claim 15, further comprising: a sockliner disposed above said sole and said support member.

* * * * *